United States Patent [19]

Rix et al.

[11] Patent Number: 5,020,087

[45] Date of Patent: May 28, 1991

[54] DIODE FOR PROVIDING X-RAYS

[75] Inventors: William H. Rix, San Diego; John P. Shannon, deceased, late of Escondido, both of Calif., by Cynthia N. Shannon, legal representative

[73] Assignee: Maxwell Laboratories, Inc., San Diego, Calif.

[21] Appl. No.: 434,935

[22] Filed: Nov. 9, 1989

[51] Int. Cl.[5] ..... H01J 35/06; H01J 35/00; H01J 35/10; H01J 35/08

[52] U.S. Cl. ..... 378/134; 378/121; 378/119; 378/125; 378/124

[58] Field of Search ..... 313/1, 2.1, 146, 145, 313/16; 378/119, 150, 121, 122, 134, 124, 125, 126, 137, 138

[56] References Cited

U.S. PATENT DOCUMENTS 4,359,660 11/1982 Smith et al. ..... 378/119

OTHER PUBLICATIONS

Riordan et al., "Recent Bremsstrahlung Source Development at Physics International", Physics International Company, presented at DNA Advanced Pulse Power Conference, NVOO-Las Vegas, Nevada, Apr. 21-22, 1988.

Maxwell Laboratories, Inc., "Preliminary Engineering Design of Bremsstrahlung Source Module for AEETES Facility", MLR-260, Jun. 22, 1973.

*Primary Examiner*—Janice A. Howell
*Assistant Examiner*—Don Wong
*Attorney, Agent, or Firm*—Fitch, Even, Tabin & Flannery

[57] ABSTRACT

Diode for providing X-rays. A diode for generating X-rays is adapted for connection to a source of high electrical energy with the diode having a first end from which the X-rays are emitted, a second end, and axis extending between the ends. The diode includes a ring cathode connected to the electron source and an intermediate anode spaced from the cathode with at least a portion of this anode being disposed between the ring cathode and the diode first end. The intermediate anode decelerates electrons to cause the generation of X-rays emitted from the diode first end. The diode also includes an intermediate cathode disposed radially outwardly of the intermediate anode and connected to this anode. The diode further includes an inverse anode spaced from the intermediate cathode and positioned radially outwardly of the intermediate cathode and between the intermediate cathode and between the intermediate cathode and the diode second end. The inverse anode also decelerates electrons to cause the generation of X-rays emitted from the diode first end generally radially outwardly of the X-rays resulting from operation of the intermediate anode. The inverse anode is connected to ground so that the diode forms a pair of anode-cathode gaps in series to divide the energy of the electrons and to cause more uniform emission of X-rays from the diode first end.

14 Claims, 5 Drawing Sheets

DIODE FOR PROVIDING X-RAYS

This invention relates to apparatus for providing X-rays and, more specifically, to a diode for providing a variable spectrum of X-rays. Work relating to their invention was performed under Defense Nuclear Agency Contract DNA001-85-C-0232. The Government has certain rights in this invention.

BACKGROUND OF THE INVENTION

There is a need to generate X-rays of the type occasioned by the detonation of a nuclear weapon to test the effects of such radiation on various electronic hardware. Such a nuclear detonation results in a electromagnetic pulse (EMP) which can greatly reduce the resistance of semiconductor junctions even when the electronic hardware is located a distance from the detonation, causing such junctions to carbonize due to the vastly increased current through the junctions. As the EMP is spectrum dependent, it is desirable to have the capability of varying the spectrum of the X-rays provided by such generation equipment.

The power weighted mean electron energy necessary for generation of the desired X-rays is at least about 1 MeV. Such a high energy level requires careful design of a diode X-ray source to avoid electrical flashover. Diodes incorporating a pair of anode-cathode gaps in series have been proposed to reduce the electrical stress appearing at a given anode-cathode gap.

One proposed series diode includes a pair of inverse anode-cathodes. By "inverse" is meant that the photons, resulting from electrons crossing the gap and being decelerated by the anode, flow in the opposite direction to the electrons crossing the gap. Each of the cathodes is transparent to the photons in that each is formed by an array of spaced, electrically conductive wires. This diode does not provide a varying spectrum of X-rays because the anode-cathode gaps are not easily adjusted. Furthermore, "transmission" diodes, diodes where the generated photons and electrons crossing the gap both flow in the same direction, are more efficient than inverse diodes above about 500 keV because at that energy level forward scattering of the photons is more dominant. Also with such series diodes various components, such as the cathodes, may need to be replaced after each shot. Such transparent electrodes may require appreciable set-up time thereby reducing the shot rate. For further information concerning the structure and operation of such a series diode, reference may be made to U.S. Pat. No. 4,354,660.

SUMMARY OF THE INVENTION

Among the aspects and features of the present invention may be noted the provision of an improved series diode. The series diode of the present invention can provide X-rays of various wavelengths because the anode-cathode gaps can be easily adjusted from shot-to-shot. The series diode includes one of the more efficient transmission diodes in series with an inverse diode for the more efficient conversion of the X-rays. Furthermore at least one of the anodes is formed by a convertor foil which is much easier to assemble and replace than forming an array of wires. Additionally, the series diode of the present invention is reliable in use and is relatively easy and economical to manufacture. Other aspects and features of this invention will be, in part, apparent and, in part, pointed out specifically in the following description and accompanying drawings.

Briefly, the diode is adapted for connection to a source of high electrical energy with a source of high energy electrons and a ground. The diode has a first end from which the X-rays are emitted, a second end and an axis extending between the ends. The diode includes a ring cathode connected to the electron source, and an intermediate anode spaced from the cathode and at least a portion of which is positioned between the ring cathode and the diode first end. This intermediate anode includes a convertor foil for decelerating electrons to cause the generation of X-rays emitted from the first end. The diode also includes an intermediate cathode disposed radially outwardly of the intermediate anode and connected to that anode. The diode also includes an inverse anode which is spaced from the intermediate cathode and which is positioned radially outwardly of the intermediate cathode and between that cathode and the diode second end. The inverse anode includes structure for decelerating electrons to cause a generation of X-rays which are emitted from the diode first end generally radially outwardly of the X-rays resulting from the intermediate anode. This inverse anode is connected to ground so that the diode forms a pair of anode-cathode gaps in series to divide the energy of the electrons and to cause more uniform emission of the X-rays from the diode first end.

BRIEF DESCRIPTION OF THE DRAWINGS

Corresponding reference characters indicate corresponding components throughout the several views of the drawings.

DESCRIPTION OF THE PREFERRED EMBODIMENT

Figure 1:
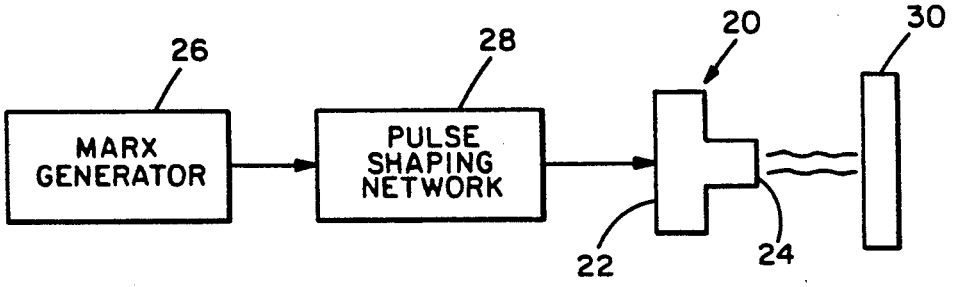
FIG. 1 is a block diagram of an apparatus for providing X-rays including a diode embodying various aspects of the present invention.
Figure 3:
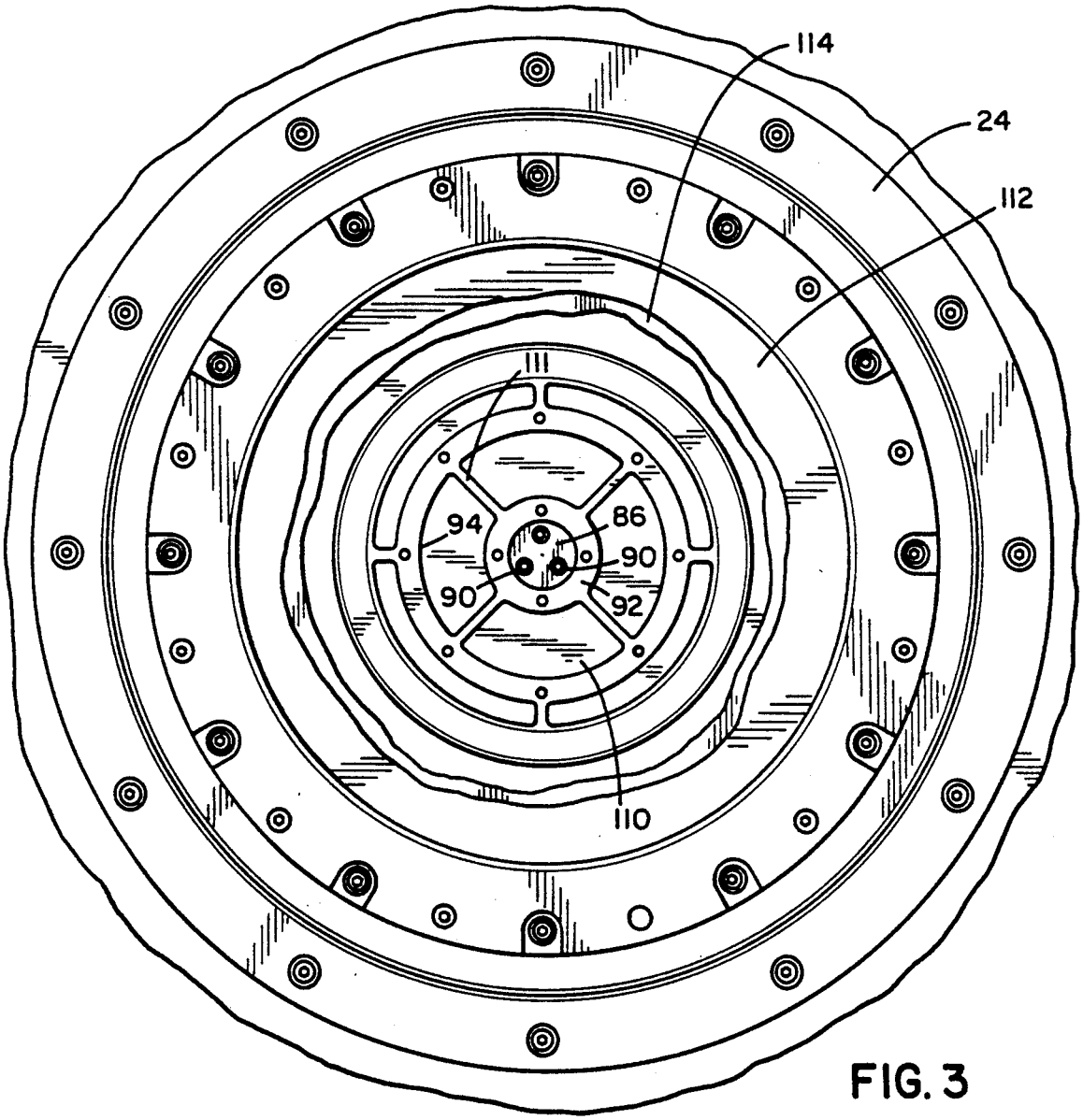
FIG. 3 is a front elevational view of the diode which certain components broken away to expose underlying components.

Referring now to the drawings, a diode for generating X-rays and adapted for connection to a source of high electrical energy is generally indicated by reference numeral 20. As shown in FIG. 1, the diode 20 has a first or input end 22 and a second or output end 24. The source of high electrical energy could include a Marx impulse generator 26 connected to the diode input end through a pulse shaping network 28. Such generators and networks are well known to those of skill in the art and need not be discussed in greater detail here. Suffice it to say that the generator and network combine to supply to the diode input an electrical pulse that is approximately 100 nanoseconds wide at half of the maximum value of the pulse. In response to application of the electrical pulse, the diode 20 provides X-rays from its output end 24 for impingement on electrical hardware 30 to be tested for the effects of the X-rays.

Figure 4:
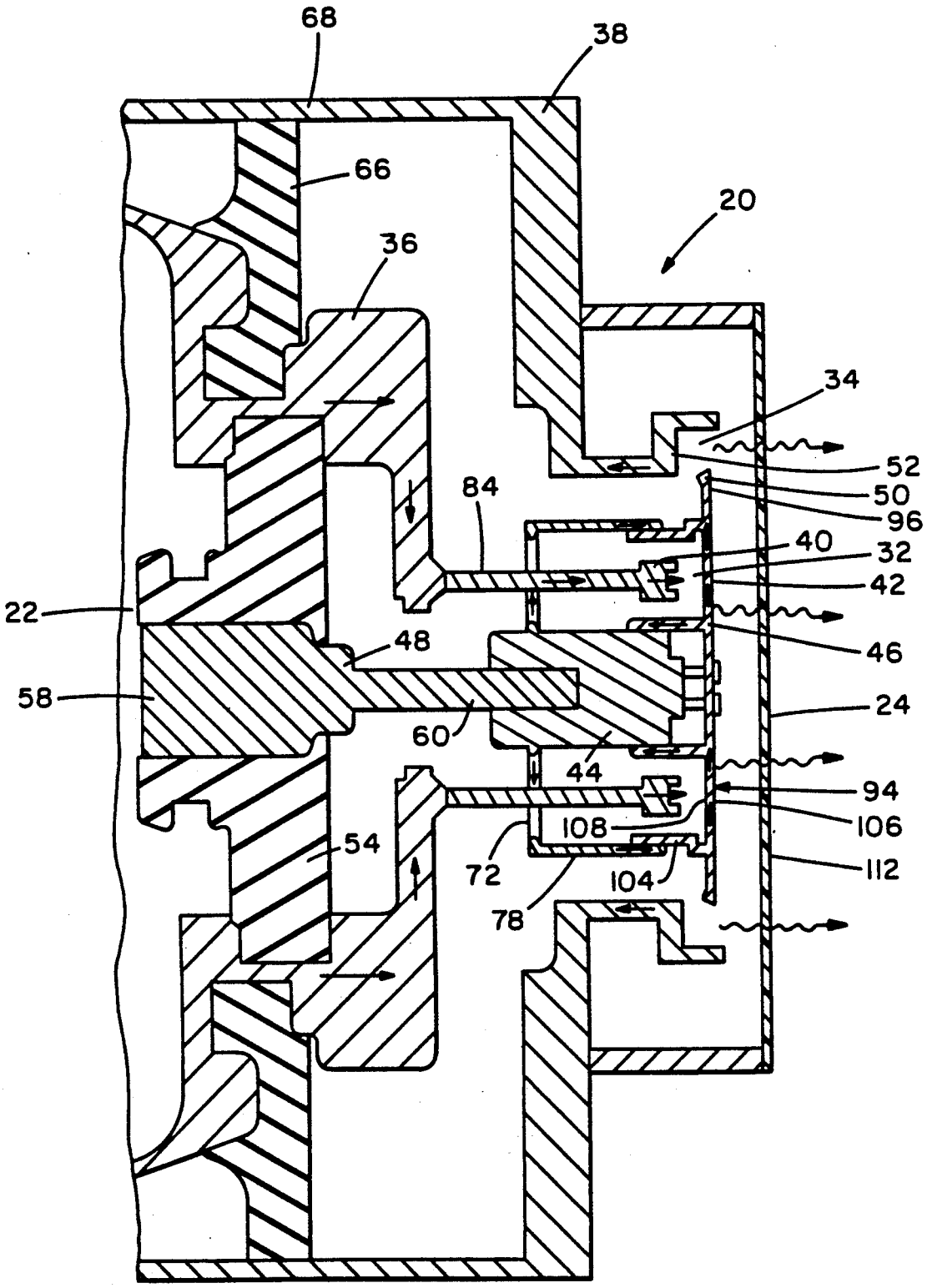
FIG. 4, similar to FIG. 2, is a simplified cross-sectional view illustrating the direction of currents in various portions of the diode, and the direction of X-ray emission.

The diode 20, as shown in the simplified cross-sectional schematic of FIG. 4, includes a first anode-cathode gap 32 in series with a second anode-cathode gap 34 between a high negative potential electron source 36 and a ground potential electron return 38, thus the term "series diode". The first anode-cathode is of the highly efficient transmission type and includes a ring cathode 40 and an intermediate anode 42. Cathode 40 is supported by the electron source 36, while the anode 42, which includes a fixed portion 44 and a movable portion 46, is held by a main support shaft 48 extending along the axis of the diode between input end 22 and output end 24. The second anode-cathode is of the inverse type and includes an intermediate cathode 50, which is connected to and radially outward of the movable portion 46 of ,the intermediate anode 42, and an inverse anode 52 which is supported by the ground 38. It will be appreciated that the wavelength of the X-rays provided by the diode 20 is a function of the lengths of the gaps 32 and 34. By movement of the movable portion 46 of the intermediate anode 42, both gaps can be adjusted to vary the spectrum of the X-rays. In both FIGS. 2 and 4, the gap spacing is greatly exaggerated for ease of visualization and explanation.

Figure 2:
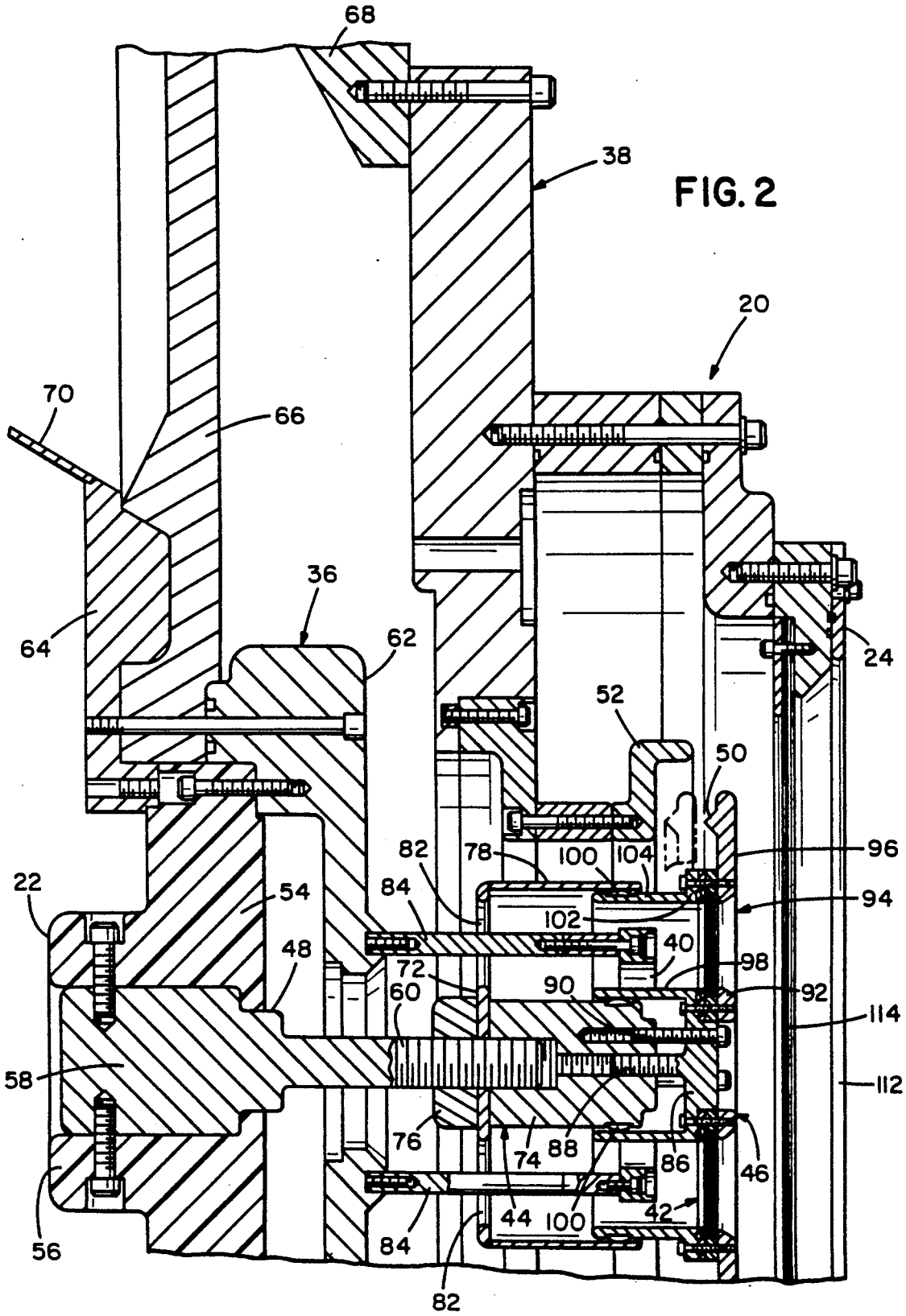
FIG. 2 is an enlarged cross-sectional view of the diode of FIG. 1 which includes a pair of anode-cathode gaps in series and a ring, rotation of which effects variation of gaps to vary the spectrum of the X-ray output.

More specifically and referring to FIG. 2, the diode 20 further includes a support plate insulator 54 having a hub 56 with a cavity which receives the enlarged head 58 of the main support shaft 48. The head 58 is secured in the hub by means of threaded fasteners, and the shaft 48 has a leading end 60 with an external screw thread. The electron source assembly 36 includes an annular inner conductor 62 attached to the support plate insulator 54 adjacent the periphery of the insulator. Inner conductor 62 is joined to an outer conductor 64 through a second annular insulator plate 66 disposed radially outwardly of the insulator 54. The second insulator 66 isolates the inner and outer conductors from an outer metallic wall 68 which is part of the ground assembly 38, while the outer conductor 64 includes a terminal 70 for connection to the pulse shaping network 28.

Figure 6:
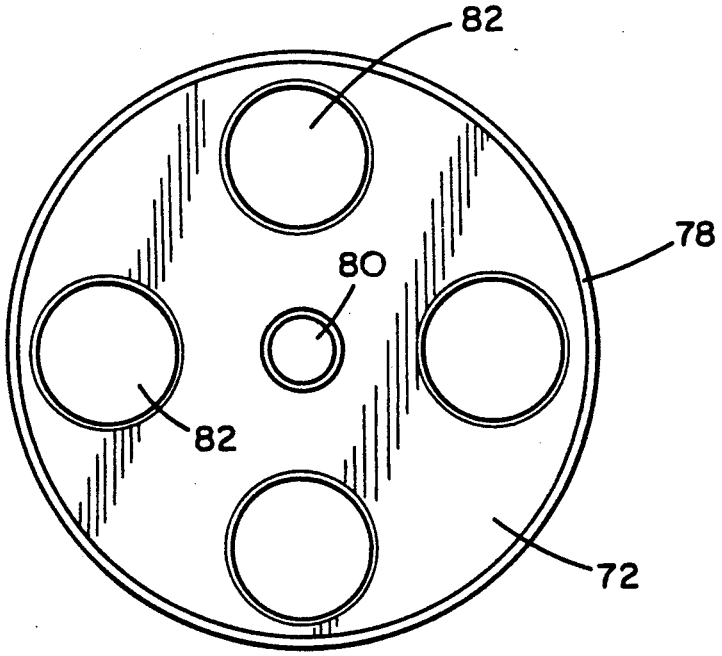
FIG. 6 is a front elevational view of a back wall of a fixed intermediate anode.
Figure 7:
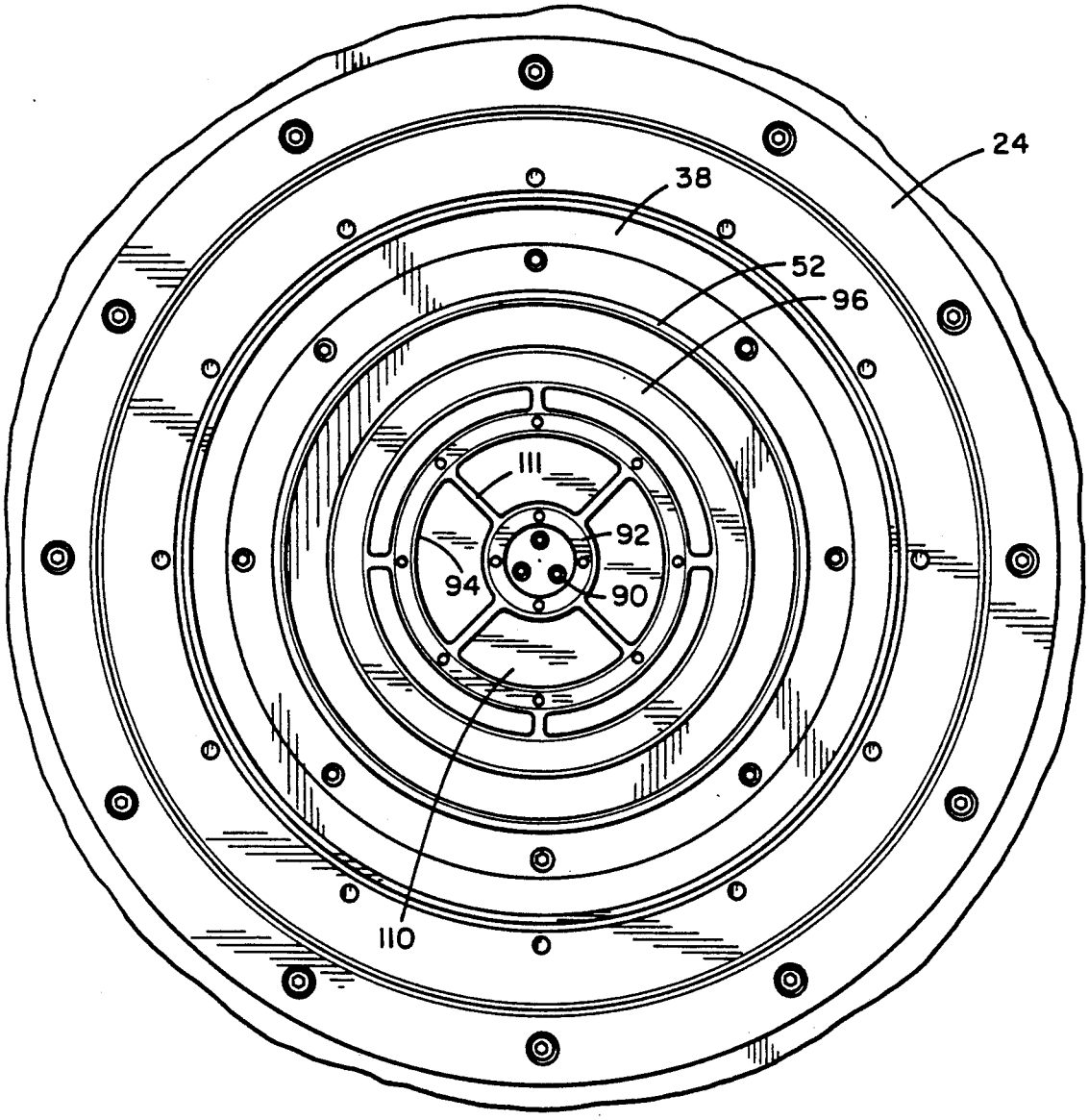
FIG. 7, similar to FIG. 3, is a front elevational view of the diode with a vacuum barrier and a debris stop removed to indicate, in conjunction with FIG. 4, location of x-ray emission.

Mounted on the leading end 60 of the shaft 48 is the fixed intermediate anode portion 44 which includes a back wall 72 and a center support 74 having a first internal screw thread at its back end for engaging the external thread on the shaft leading end 60 A clamping nut 76 is provided on the shaft 48 behind the back wall 72 to permit fixing of the center support the shaft. A rear shroud 78 extends from the periphery of the back wall 72 toward the diode first end 24. As best shown in FIG. 6, the back wall 72 includes a central aperture 80 for passage of shaft leading end 60 and four regularly spaced outer windows 82. Referring to FIG. 2, a standoff post 84 passes through each window 82 and connects the ring cathode 40 to the inner conductor 62 of the electron source assembly 36.

The intermediate anode movable portion 46 includes an inner ring 86 having a central shaft 88 which is threadably received in a threaded bore at the leading end of the central support 74. Thus the inner ring 86 can be moved with respect to the central support 74 by rotation and, when the desired spacing is achieved, the inner ring can be locked in position by inserting fasteners 90 through holes in the inner ring and which are threadably received in bores in the leading end of the central support 74. The inner ring 86 is attached to the hub 92 of a clamping support 94 which also includes an outer ring 96 carrying the intermediate cathode 50.

A front shroud 98 extends rearwardly from the periphery of the inner ring 86 over the central support 74 which has an annular groove on its outer surface in which is positioned a spring contact strip 100 on which bears on the inner surface of the front shroud- 98 to maintain conduction between the shroud and the support as the inner ring 86 is rotated. The movable intermediate anode portion 46 also includes an outer ring 102 having a cylindrical extension 104 which has an annular groove on its outer surface seating another spring contact strip which bears on the inner surface of the rear shroud 78. Thus the cylindrical extension is rotatably supported by and maintains electrical contact with the shroud of the fixed intermediate anode portion 44.

Figure 5:
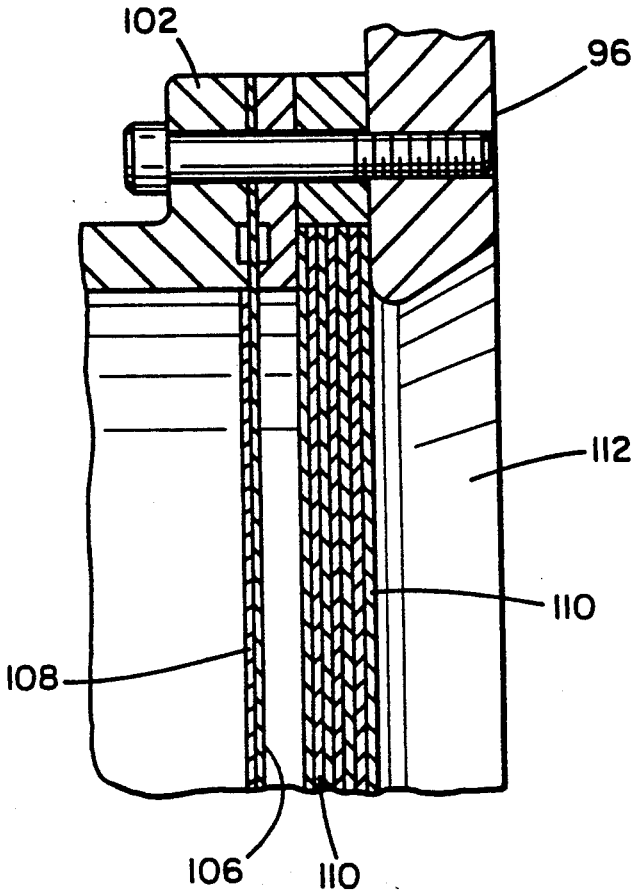
FIG. 5 is an enlarged sectional view of laminated conductor and convertor foils.

The movable intermediate anode portion 46 also includes various layers of foils extending between inner ring 86 and outer ring 102 for impingement by the electron stream emanating from ring cathode 40. Referring to FIG. 5, a layer 106 of aluminum foil, which is stretched between rings 86 and 102, backs up a layer 108 of tantalum. The layer 108 serves to slow the relativistic electrons from ring cathode 40, resulting in the production of X-rays due to the phenomenon of bremsstrahlung. The aluminum layer 106 provides support for layer 108 and a low resistance conductor for electrons to the intermediate cathode 50. Clamped between the outer rings 96 and 102 of the clamping support 94 and movable intermediate anode portion 46, respectively, are several layers 110 of graphite foil for stopping any electrons which pass through layers 106 and 108. The clamping support 94 includes spokes 111 joining hub 92 to outer ring 96. Layer 106 preferably has a thickness of about 2 mils, layer 108 a preferred thickness of about 3 mils, and each of the preferably 10 layers 110 a thickness of about 25 mils.

The diode 20 has appropriate supporting structure at the output end 24 and connected to the ground assembly 38 clamping a sheet 112 of Mylar which provides a vacuum barrier. Multiple sheets 114 of Kevlar are positioned between the intermediate anode 42 and sheet 112 to protect the Mylar sheet from debris resulting from the anode 42 being struck by the electrons.

It should be appreciated that all of the electrons impinging on the anode 42 do not reach the cathode 50 by flowing radially outwardly through layers 106 and 108. As indicated by the arrows in FIG. 4, the intermediate anode has another flow path in whiCh the electrons move toward cathode 50 by flowing radially inwardly through layers 106 and 108, through inner ring 86, radially outwardly through the back wall 72, and forwardly through rear shroud 78 and the cylindrical extension 104 of the intermediate anode outer ring 102. The flow of electrons from the ring cathode 40 to the anode 42 causes an electromagnetic field which tends to pinch the electrons toward the axis of the diode. This is undesirable because the electrons would concentrate, striking an inner area of layer 108 resulting in destruction of that area before satisfactory production of X-rays. The provision of the alternate flow path through the central support results in the creation of a countervailing electromagnetic field which greatly reduces the pinch effect resulting in the electrons striking a more diffuse area of layer 108.

The inverse anode 52, connected to the ground system 38, is positioned rearwardly and radially outwardly of the intermediate cathode 50, which is preferably in the form of a tapered annular protuberance on the outer ring 96 of the clamping support 94. The inverse anode could be formed of aluminum with a tantalum insert or could be formed in its entirety of tantalum. The electrons emanating from the intermediate cathode striking the inverse anode are slowed resulting in the formation of X-rays due to bremsstrahlung. The X-rays created can pass over the top of the outer ring 96 and through the Kevlar sheets 114 and Mylar sheet 112. By providing the two anode-cathode gaps 32 and 34 in series, the electron energy can be divided for each gap substantially in half compared to that of a diode having a single anode-cathode gap. Furthermore the electron beam may be more defuse to result in less damage to the components of the diode.

In the event that it is desired to change the spectrum of the X-rays, the fasteners 90 holding the inner ring 86 of the movable intermediate anode portion 46 can be removed from the central support 74. Thereafter, the movable anode portion can be rotated until the proper spacing is achieved at which point the fasteners 90 can be replaced to fix the position of the movable portion 46. Of course, the rotation of the movable portion changes the spacing of both the anode-cathode gaps 32 and 34. Should it be desired to adjust one gap more than the other, different lengths of standoff posts 84, which connect the ring cathode 40 to the inner conductor 62, can be employed. The series diode of the present invention offers simplified replacement of the intermediate anode layers which require replacement with each use. The movable anode portion 46 can easily be removed from the fixed anode portion 44 by rotation until the inner ring 86 disengages from the central support 74. The replacement of the various aluminum, tantalum and graphite layers 106, 108, 110, respectively, is facilitated due to the design of the clamping support 94 as well as the inner and outer rings 86 and 102 of the movable anode portion 46 which allow simplified clamping of the layers.

Operation of the diode 20 of the present invention is as follows: Upon operation of the Marx generator to provide the desired high energy pulse, the electrons flow from the ring cathode 40 and strike the tantalum layer 108 of the intermediate anode 42. This causes deceleration of the electrons resulting in the creation of X-rays. The electrons then flow through alternate paths, as discussed above, to the intermediate cathode 50 and cross the gap 34 to the inverse anode 52 where the electrons are again slowed resulting in the creation of X-rays passing through the Kevlar and Mylar layers outwardly of those resulting from electron deceleration at the first anode-cathode gap 32.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A diode for generating X-rays and adapted for connection to a source of high electrical energy having a source of high energy electrons and a ground, said diode having a first end from which said X-rays are emitted, a second end and an axis extending between said ends, said diode comprising:

a ring cathode connected to said electron source;

an intermediate anode spaced from said ring cathode and with at least a portion of said intermediate anode being disposed between said ring cathode and said diode first end, said intermediate anode having means for decelerating electrons to cause the generation of X-rays emitted from said first end;

an intermediate cathode disposed radially outwardly of said intermediate anode and connected thereto; and an inverse anode spaced from said intermediate cathode, said inverse and anode being disposed radially outwardly of said intermediate cathode and said inverse anode being positioned between said intermediate cathode and said diode second end, said inverse anode having means for decelerating electrons to cause the generation of X-rays emitted from said diode first end generally radially outwardly of the X-rays resulting from said intermediate anode, said inverse anode being connected to said ground whereby said diode forms a pair of anode-cathode gaps in series to divide the energy of the electrons and to cause more uniform emission of X-rays from said diode first end.

2. A diode as set forth in claim 1 further comprising means for adjusting the spacing of at least one of said anode-cathode gaps to permit variation in the spectrum of said X-rays.

3. A diode as set forth in claim 1 further comprising means for supporting said intermediate anode disposed along said axis, a first insulator spacing said means for supporting and said electron source, and a second insulator spacing said electron source and said ground.

4. A diode as set forth in claim 3 wherein said means for supporting includes a main support shaft fixed to said first insulator, said shaft supporting a fixed intermediate anode portion and a movable intermediate anode portion disposed between said fixed portion and said diode first end.

5. A diode as set forth in claim 4 wherein said fixed portion includes a back wall extending transversely to said axis and a cylindrical shroud extending from said back wall toward said diode first end.

6. A diode as set forth in claim 5 wherein said back wall has at least one aperture, said diode further including at least one post extending through said aperture and connecting said ring cathode to said electron source, said post extending generally parallel to and spaced from said support shaft assembly.,

7. Adiode as set forth in claim 5 wherein said movable intermediate anode portion comprises an inner ring and said fixed intermediate anode portion has a central support mounted on said shaft, said inner ring and said central support having a threaded connection so that said inner ring is supported by said shaft and so that rotation of said inner ring causes movement of said inner ring relative to said first end to vary the gap between said ring cathode and said intermediate anode.

8. A diode as set forth in claim 7 wherein said inner ring comprises a shroud extending toward said second end and overlying said shaft assembly, said central support having bearing means for rotatably supporting said ring shroud.

9. A diode as set forth in claim 7 wherein said movable intermediate anode portion further includes an outer ring having a cylindrical extension directed toward said second end, said cylindrical extension being rotatable supported by and making electrical contact with said shroud of said fixed intermediate anode portion.

10. A diode as set forth in claim 7 wherein said intermediate cathode is fixed to said inner ring whereby rotation of said ring varies both of said anode cathode gaps.

11. A diode as set forth in claim 7 wherein said movable intermediate anode portion further includes an outer ring disposed radially outwardly of said cathode ring, said movable anode portion further including a convertor foil supported between said inner and outer rings for decelerating electrons emitted from said ring cathode.

12. A diode as set forth in claim 11 wherein said convertor foil is made of tantalum.

13. A diode as set forth in claim 12 further including a conductor foil extending between said inner and outer rings for conducting electrons to said intermediate cathode.

14. A diode as set forth in claim 13 further including a graphite foil extending between said inner and outer rings and positioned between said first end and the aforementioned foils for stopping electrons which have passed those foils.

* * * * *